United States Patent [19]

Stone et al.

[11] 4,450,066

[45] May 22, 1984

[54] HYDROTHERMAL PRETREATMENT TO PREVENT SCALE DURING LIQUEFACTION OF CERTAIN SOLID CARBONACEOUS MATERIALS

[75] Inventors: John B. Stone, Houston; Frank M. Floyd, Baytown, both of Tex.

[73] Assignee: Exxon Research and Engineering Co., Florham Park, N.J.

[21] Appl. No.: 440,062

[22] Filed: Nov. 8, 1982

Related U.S. Application Data

[63] Continuation of Ser. No. 183,479, Sep. 2, 1980, abandoned.

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 1,959,175 | 5/1934 | Pier et al. | 208/8 R |
| 3,379,638 | 4/1968 | Bloomer et al. | 208/8 LE |
| 3,488,279 | 1/1970 | Schulman | 208/8 LE X |
| 3,617,513 | 11/1971 | Wilson et al. | 208/8 LE X |
| 3,660,269 | 5/1972 | McCauley | 208/8 LE |
| 4,304,655 | 12/1981 | Poddar | 208/8 LE |
| 4,347,117 | 8/1982 | Bauman et al. | 208/8 LE |
| 4,351,716 | 9/1982 | Gorboty et al. | 208/8 LE |

OTHER PUBLICATIONS

Chemical Rubber Co., Handbook 1971–1972 Ed. D–149.

*Primary Examiner*—Delbert E. Gantz
*Assistant Examiner*—William G. Wright
*Attorney, Agent, or Firm*—Wayne Hoover

[57] ABSTRACT

Scale formation during the liquefaction of lower ranking coals and similar carbonaceous materials is significantly reduced and/or prevented by hydrothermal pretreatment. The said pretreatment is believed to convert the scale-forming components to the corresponding carbonate prior to liquefaction. The said pretreatment is accomplished at a total pressure within the range from about 1000 to about 4400 psia. Temperature during said pretreatment will generally be within the range from about 500° to about 700° F.

7 Claims, 1 Drawing Figure

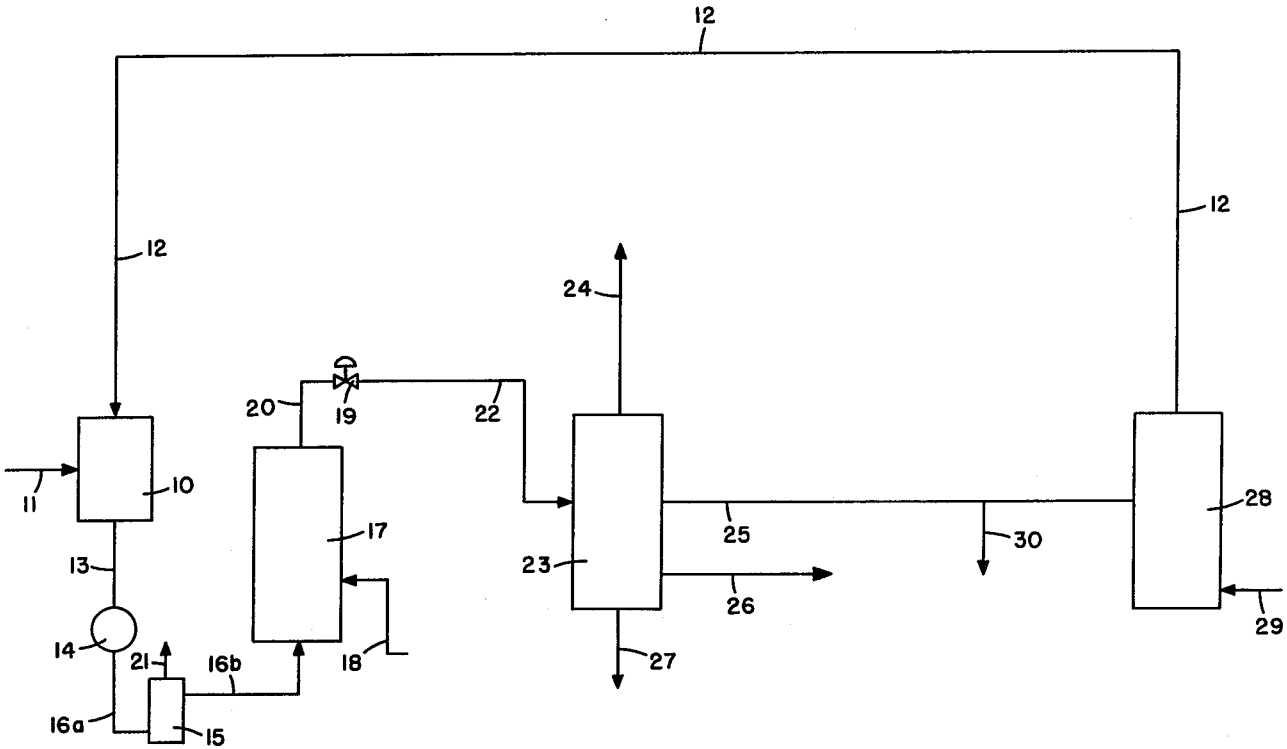
12
12
12
10
11
13
14
15
16a
16b
17
18
19
20
21
22
23
24
25
26
27
28
29
30

HYDROTHERMAL PRETREATMENT TO PREVENT SCALE DURING LIQUEFACTION OF CERTAIN SOLID CARBONACEOUS MATERIALS

The Government of the United States of America has rights in this invention pursuant to Contract No. DE-FC01-77ET10069 (formerly Contract No. EF-77-A-01-2893) awarded by the U.S. Energy Research and Development Administration, now the U.S. Department of Energy.

This is a continuation of application Ser. No. 183,479, filed Sept. 2, 1980, now abandoned.

BACKGROUND OF THE INVENTION

1. Field of the Invention

This invention relates to an improved process for converting coal or similar solid carbonaceous material containing certain mineral matter. More particularly, this invention relates to an improved process for liquefying coal and similar carbonaceous materials.

2. Description of the Prior Art

As is well known, coal has long been used as a fuel in many areas. For several reasons, such as handling problems, waste disposal problems, pollution problems and the like, coal has not been a particularly desirable fuel from the ultimate consumers point of view. As a result, oil and gas have enjoyed a dominant position, from the standpoint of fuel sources, throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously.

To this end, several processes wherein coal is either liquefied and/or gasified have been proposed heretofore. Of these, the processes wherein coal is liquefied appear to be more desirable in most cases since a broader range of products is produced and these products are more readily transported and stored. Difficulty has, however, been encountered during the liquefaction of certain coals, particularly the lower ranking coals, apparently as the result of extraneous mineral matter contained in these coals.

While the inventors here do not wish to be bound by any particular theory, it is believed that the operating difficulties are associated with the presence of one or more alkaline earth metals, particularly calcium, and to some extent the presence of iron, which react during liquefaction with available anions to form a solid scale or deposit. A large portion of the scale remains in the liquefaction reactor thereby reducing reactor volume, and hence, the liquefaction contacting time and/or the total throughput. Ultimately, complete plugging may occur. Moreover, a portion of the scale or deposit remains in the liquid product and has resulted in downstream plugging.

The scaling and/or deposit problem is believed to have been first reported upon in the literature in connection with the operation of a high pressure coal liquefaction plant for producing liquids from lignites at Wesseling, near Cologne, Germany. According to the literature, operation of this plant was severely limited by a solid referred to as "caviar", the reference apparently stemming from the appearance of the solid in the form of agglomerated balls or spherulites. According to the literature, the spherulites were found to comprise calcium carbonate and hexagonal crystals of iron sulfide.

Early attempts to solve the problem involved the use of what might be termed engineering techniques which were designed either to prevent scale formation or to remove the scale before operating problems were encountered. In one such technique, a small slipstream was withdrawn from an initial reactor of a series in a process. With this technique, the initially formed small particles were continuously withdrawn and removed and the slipstream then returned to the reactor. This technique aided in suppressing further crystal growth and slowed down the rate of scale formation within the reactor. The technique did, however, result in high gas losses and high erosion rates within auxiliary equipment.

More recently, it has been discovered that calcium carbonate deposits which form during liquefaction as the result of the decomposition of various calcium organic compounds can be avoided by converting the calcium organic compounds, which do decompose during liquefaction, to a salt which will remain stable during liquefaction or to a form which can be removed prior to liquefaction. Conversions of this type can be effected with a relatively broad range of pretreating agents including salts of metals different from calcium which will, effectively, replace the calcium in the coal, various organic and inorganic acids and certain gaseous pretreating agents such as $SO_2$ and $SO_3$. Carbonic acid is included among the list of known pretreating agents.

For the most part, these ion exchange-type pretreatments have been quite effective in solving the scale or deposition problem. Most such treatments, however, involve the use of aqueous solutions of pretreating agents thereby increasing the amount of water which must be removed either prior to or during liquefaction. Moreover, many of these pretreatments increase the amount of ash or residue which must ultimately be disposed of and/or involve the use of pretreating agents which are known pollutants and therefore which must be separated from any gas stream ultimately vented to the atmosphere and some of which are hazardous in their own right. The need, therefore, for an improved method of avoiding the scale and/or solid deposition problem is believed to be readily apparent.

SUMMARY OF THE INVENTION

It has now, surprisingly, been discovered that the foregoing disadvantages of the prior art pretreatment methods can be overcome with the method of the present invention and a method for more effectively liquefying lower ranking coals provided thereby. It is, therefore, an object of this invention to provide an improved method for liquefying lower ranking coals and similar carbonaceous materials containing organic salts of alkali metals which decompose during liquefaction to produce a scale and/or solid deposit which hampers smooth operation. It is still another object of this invention to provide such an improved process wherein the scale and/or solid deposition problem is avoided by pretreatment of the coal or similar carbonaceous material to be liquefied in a manner which does not require the use of added water. It is still another object of this invention to provide such an improved process wherein the pretreatment is accomplished in a manner which does not require the use of a pretreating agent and hence which does not require the use of such an agent which is a pollutant or which is hazardous to use. It is yet another object of this invention to provide such an improved process wherein the pretreatment is accomplished with a pretreating agent which does not result in an increase in the amount of residue which will ultimately be discarded. These and other objects and advantages will become apparent from the description set forth hereinafter.

In accordance with this invention, the foregoing and other objects and advantages are accomplished by subjecting a lower ranking coal or similar carbonaceous material to a hydrothermal pretreatment and thereafter liquefying. As indicated more fully hereinafter, it is important that the pretreatment be accomplished at an elevated temperature and that the pretreatment be accomplished at a total pressure sufficient to maintain at least a portion of the moisture contained in the coal in the liquid state. As also more fully indicated hereinafter, liquefaction of the pretreated coal or similar carbonaceous material may be accomplished in accordance with any of the techniques known in the prior art to be effective for this purpose.

BRIEF DESCRIPTION OF THE DRAWING

The attached drawing is a schematic flow diagram of a process within the scope of this invention.

DETAILED DESCRIPTION OF THE INVENTION

As indicated supra, the present invention relates to an improved process for the liquefaction of lower ranking coals and similar carbonaceous materials. The improvement comprises a hydrothermal pretreatment of the coal or similar carbonaceous material to either eliminate or at least significantly reduce the formation of solid deposits during liquefaction which ultimately result in scale formation and/or plugging. As also indicated supra, the scale and plugging is believed to be due to the decomposition of alkaline earth metal humates and particularly calcium humates during liquefaction and the concurrent or subsequent formation of calcium carbonate. In the present invention, the formation of alkaline earth metal carbonates and particularly calcium carbonate during liquefaction is reduced or eliminated by decomposing the alkaline earth metal humates by a hydrothermal pretreatment prior to liquefaction. As indicated more fully hereinafter, the alkaline earth metal salt or salts which are formed as a result of the pretreatment will be finely divided and, while it remains with the coal during liquefaction, it does not agglomerate or form scale.

In general, the improved method of this invention can be used with any coal containing one or more alkaline earth metal humates and particularly any coal containing calcium humate. Such coals include the subbituminous coals, lignite, peat, brown coal and similar solid carbonaceous materials.

In general and prior to the pretreatment of this invention, the coal will be ground to a finely divided state. The particular particle size, or particle size range actually employed will depend a great deal upon the optimum size to be used in the subsequent liquefaction conversion, although the actual particle size range employed will have some effect on the rate of decomposition of the alkaline earth metal humate during the hydrothermal pretreatment. In this regard, it should be noted that in most liquefaction processes the coal to be liquefied will, generally, be ground to a particle size of less than about ¼ inch and preferably to a particle size of less than about 8 mesh NBS sieve size. The smaller size will, of course, enhance both the pretreatment decomposition rate and the subsequent rate of liquefaction.

In general, the pretreatment of the present invention can be effected simply by heating the coal, preferably in a finely divided state, to a temperature within the range from about 500° to about 700° F. at a total pressure within the range from about 1000 to about 4400 psia and holding the coal or other carbonaceous material at these conditions for a period within the range from about 15 to about 120 minutes. Best results will, however, be obtained when the finely divided coal is combined with a hydrocarbon solvent and preferably the solvent to be used during the subsequent liquefaction. Moreover, while the finely divided coal may be combined with the solvent in essentially any ratio, or at essentially any concentration, best results will, generally, be achieved when the coal is combined with the solvent at the same ratio as that employed during the subsequent liquefaction.

It is important that the coal be subjected to a hydrothermal treatment in accordance with the present invention and contain between about 20 and 40% moisture and that the hydrothermal treatment be effected at a total pressure sufficient to retain at least a portion of this moisture in the liquid state during the treatment. As indicated more fully infra, best results are achieved when substantially all of the moisture is retained in the liquid state. Operation of a pressure of at least 10% above the vapor pressure of water at the treating temperature is, therefore, preferred and operation at a pressure of at least 20% above the vapor pressure of water at this temperature is most preferred. There is, of course, no criticality associated with the maximum pressure employed during the hydrothermal pretreatment, but for practical reasons the pretreatment will not, generally, be accomplished at a pressure above the pressure used during liquefaction.

While the inventors do not wish to be bound by any particular theory, it is believed that carbon dioxide is released during the hydrothermal treatment of this invention, probably as the result of the calcium humates. The liberated carbon dioxide is then absorbed by the water which is effectively retained in the coal pores by the hydrocarbon solvent and the elevated pressure and reacts with the liberated alkaline earth metal to form the corresponding alkaline earth metal bicarbonate and/or carbonate. The bicarbonate is then converted to the corresponding carbonate when the coal moisture is driven off.

Following the pretreatment, the coal may then be liquefied by any of the methods known in the prior art to be effective therefor. Such methods include processes wherein the coal is simply subjected to pyrolysis in the absence of air or oxygen, processes of the type where the coal is heated in the presence of hydrogen and processes wherein coal is liquefied in the presence of a solvent.

In those processes where the coal is pyrolyzed either in the presence of an inert or in the presence of hydrogen, contacting can be accomplished either in a fixed bed, a fluid bed or in a slurry. Generally, pyrolysis is effected at a temperature within the range from about 350° F. to about 800° C.

In those processes where a solvent is used, any liquid-solid contacting can be employed. In those processes wherein a carrier liquid or solvent is used, liquefaction is generally accomplished at a temperature within the range from about 350° F. to about 500° C. and the ratio of coal-to-liquid generally ranges from about 1:1 to about 1:4. The carrier liquid or solvent may or may not act as a hydrogen transferring media. In those cases where the carrier liquid and/or the solvent act as a hydrogen donor, the carrier liquid and/or solvent will, generally, be withdrawn from the liquefaction vessel and hydrogenated so as to restore the desired hydrogen content. Such hydrogenation will, of course, be accomplished in accordance with techniques well known in the prior art and forms no part of the present invention; such a process is described in U.S. Pat. No. 3,617,513.

DESCRIPTION OF THE PREFERRED EMBODIMENT

In a preferred embodiment of the present invention, a lower ranking coal such as subbituminous coal or a lignite is ground to a finely divided state and then contacted with hydrocarbon solvent. The coal/solvent slurry will then be heated to a temperature within the range from about 500° F. to about 700° F. The slurry will then be held at this temperature for a period of time within the range from about 15 to about 120 minutes at a total pressure within the range from about 70 to about 300 atmospheres. Following the hydrothermal treatment, the coal can be dried by any conventional techniques, one being to reduce the pressure by an amount to allow the coal moisture to vaporize.

In a preferred embodiment, the coal, during the hydrothermal treatment will contain at least 20 weight percent water and the treatment will be accomplished at conditions which avoid or prevent the loss of water during the pretreatment. In a most preferred embodiment, the coal will be treated "as received" and contain from about 20 to about 40 weight percent water.

When the coal is pretreated in accordance with the method of the preferred embodiment, from about 60 to about 100 percent of the alkaline earth metal humates originally present in the coal will be converted into an insoluble, thermally stable alkaline earth metal carbonate which remains within the coal and is released during liquefaction as particulate solids which are recovered with the liquefaction bottoms. Interestingly, even though the metal salt formed as a result of the hydrothermal treatment is believed to be the principle cause of scaling and/or plugging when the same is formed during liquefaction, the alkaline earth metal carbonate, which is carried into the liquefaction stage after the hydrothermal treatment, remains finely divided, does not agglomerate and does not result in scale formation and/or plugging.

In the preferred embodiment and before the pretreatment, the finely divided coal will be admixed with a recycle donor solvent. The total solvent and coal will, generally, be admixed in a solvent-coal ratio ranging from about 0.8:1 to about 4:1, most preferably from about 1.2:1 to about 1.6:1, based on weight. In the preferred embodiment, the solvent will be one derived from coal and will boil within the range from about 400° F. to about 850° F., most preferably from about 400° F. to about 700° F. After the coal-solvent slurry is formed and hydrothermally treated, the same will, generally, be transferred with molecular hydrogen into a coal liquefaction zone.

Within the coal liquefaction zone, liquefaction conditions include a temperature ranging from about 700° F. to about 950° F., preferably from about 800° F. to about 850° F., with pressures ranging from about 300 psia to about 3000 psia, most preferably from about 800 psia to about 2000 pisa. Preferably, molecular hydrogen will be added to the liquefaction zone at a rate from about 1 to about 6 weight percent (MAF coal basis). Liquid residence times will, generally, range from about 5 to about 130 minutes and most preferably will range from about 10 to about 60 minutes.

The product from the coal liquefaction zone consists of gases and liquids, the liquids comprising a mixture of undepleted hydrogen donor solvent, depleted hydrogen donor solvent, dissolved coal, undissolved coal and mineral matter. In the preferred embodiment, the liquid mixture will be transferred to a separation zone wherein light fractions boiling below 400° F. and useful as fuel gas, a naphtha fraction, a hydrogen donor solvent fraction, a fuel oil fraction and a bottoms fraction is recovered. The bottom fraction, which generally will boil above about 1000° F. will include char, mineral matter and ash and may subsequently be fed to a gasification or coking process.

In the preferred embodiment, the solvent fraction will be hydrogenated before the same is recycled to the liquefaction zone. Preferably the hydrogenation will be accomplished catalytically at conditions known to be effective for this purpose in the prior art. Normally, these include temperatures within the range from about 650° F. to about 850° F. and a pressure within the range from about 650 psia to about 2000 psia. The hydrogen treat rate during the hydrogenation generally will be within the range from about 500 to about 10,000 SCF/BBL. Any of the known hydrogenation catalysts may be employed. Following hydrogenation, the solvent may then be used to slurry additional pretreated coal.

As a result of the hydrothermal treatment, scaling and/or plugging which is normally encountered during the liquefaction of lower ranking coals is either significantly reduced or eliminated. As a result, longer periods of uninterrupted operation are possible and there is little, if any, need to reduce the throughput during these operations.

It is believed that the invention will be even better understood by reference to the attached FIGURE which illustrates a particularly preferred embodiment. Referring then to FIG. 1, a finely divided lower ranking coal is introduced into mixing vessel 10 through line 11 and slurried with recycle solvent which is introduced through line 12. As indicated hereinafter, the recycle solvent is hydrogenated prior to introduction into mixing vessel 10. The coal/solvent slurry is then withdrawn from the mixer through line 13 and passed through heat exchanger 14. In the preheater, the slurry will be heated to a temperature within the range from about 500° to about 700° F. and held at this temperature for a period within the range from about 15 to about 120 minutes at a pressure within the range from about 1000 to about 4400 psia. In the embodiment illustrated, the pressure will be dropped an amount to allow flashing of the coal moisture in knock-out drum 15. The slurry is transferred to knock-out drum 15 through line 16. Steam will be withdrawn through line 21 so that the moisture content of the coal in the slurry will be within the range from about 0 to about 10 weight percent when the slurry is withdrawn through line 16 and fed to liquefaction vessel 17. The reduction in pressure caused by the expansion in knockout drum 15 also results in the conversion of any alkaline earth metal bicarbonate to the corresponding carbonate which will remain inert during the subsequent liquefaction.

In the liquefaction vessel, the coal/solvent slurry is combined with molecular hydrogen which is introduced through line 18. Generally, hydrogen will be added in an amount within the range from about 1 to about 6 weight percent based on dry coal. In the preferred embodiment, the liquefaction vessel will be sized so as to provide a nominal holding time within the range from about 5 to about 130 minutes and heat will be added or removed as required to maintain a temperature in the liquefaction vessel within the range from about 700° to about 950° F. Pressure in the liquefaction vessel will be maintained at a value within the range from about 300 to about 3000 psia with control valve 19 which is located in product withdrawal line 20.

After the products from the liquefaction vessel pass through pressure control valve 19 they are then fed through line 22 to atmospheric fractionator 23. At this point, the product stream comprises product gases, product liquids, spend solvent, dissolved coal and mineral matter. In the atmospheric fractionator 23, the product stream is separated to a more desirable distribution. Essentially any distribution could, of course, be obtained but in the embodiment illustrated, the gaseous components and the lighter liquid hydrocarbon products are taken overhead through line 24. A middle fraction comprising the spent solvent as well as liquid product boiling in the range of the spent solvent is withdrawn through line 25. A heavier liquid product is then withdrawn through line 26 and may be further separated using conventional techniques such as vacuum fractionation. The undissolved coal and the solid mineral matter is withdrawn through line 27. Again, the unreacted coal and the mineral matter may be subjected to further treatment such as coking and/or gasification using conventional techniques.

In the preferred embodiment, the solvent fraction withdrawn through line 25 will be hydrogenated before the same is recycled to mixing vessel 10. Preferably, the hydrogenation will be accomplished catalytically at conditions known to be effective for this purpose in the prior art. In the embodiment illustrated, the hydrogenation is accomplished in hydrogenation vessel 28 with a gas comprising molecular hydrogen or a hydrogen donor introduced through line 29. The hydrogenated product is then recycled to mixing vessel 10 through line 12. In those cases where the amount of liquid withdrawn through line 25 exceeds the amount of solvent required during liquefaction, any excess may be withdrawn through line 30 prior to hydrogenation.

Normally, the hydrogenation will be accomplished at a temperature within the range from about 650° F. to about 850° F. and at a pressure within the range from about 650 to about 2000 psia. The hydrogen treat rate during the hydrogenation will be within the range from about 500 to about 10,000 SCF/BBL. Any of the known hydrogenation catalysts may be employed but a nickel moly catalyst is most preferred.

Having thus broadly described the present invention and a preferred embodiment thereof, it is believed that the same will become even more apparent by reference to the following examples. It will be appreciated, however, that the examples are presented solely for purposes of illustration and should not be construed as limiting the invention.

EXAMPLE I

Six grams of an "as received" Wyodak coal (containing 30 percent water) was ground to a particle size ranging from about 8 to about 325 mesh (NBS) and placed in an autoclave. A partially hydrogenated creosote oil solvent was then added to the autoclave and the contents of the autoclave were then brought to a temperature of 620° F. and held for a period of 60 minutes at a total pressure of 2300 psia. The pressure on the autoclave was then released and the coal vacuum dried at 140° F. for about 16 hours. The treated coal was then subjected to x-ray analysis and carbonate analysis by acid evaluation. The presence of calcium carbonate was clearly indicated.

A portion of the thus treated Wyodak coal was then liquefied in a batch tube autoclave at a temperature of 840° F. and a pressure of 2000 psig. The liquefaction was accomplished in the presence of a hydrogen donor solvent coal ratio of 1.6:1. The liquefaction was also accomplished in the presence of 3 weight percent added molecular hydrogen, based on coal. Following the liquefaction, the autoclave was inspected for scale and agglomerated alkali metal carbonate. None were detected.

EXAMPLE II

In this example, the methods set forth in Example I were repeated except that the temperature was reduced to 600, the total autoclave pressure during treatment was reduced to 1900 psig and the holding time was held constant at 60 minutes. Following this treatment, the coal was again dried and subjected to x-ray analysis and carbonate analysis by acid evaluation. The presence of calcium carbonate was again detected.

The pretreated coal was then subjected to liquefaction in the same manner as described in Example I. Following the liquefaction, the autoclave was inspected for scale and agglomerated alkaline earth metal carbonates. None were detected.

While the present invention has been described and illustrated by reference to a particular embodiment thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A process for the liquefaction of a lower ranking coal or similar solid carbonaceous material containing from about 20 to about 40 weight percent moisture consisting essentially of the steps of:

(a) hydrothermally pretreating said coal or carbonaceous material by heating the coal or solid carbonaceous material to a temperature within the range from about 500° to about 700° F. at a total pressure at least 10% above the vapor pressure of water at the pretreating temperature to reduce the amount of alkaline earth metal humates therein;

(b) liquefying the thus treated coal at liquefaction conditions to produce a petroleum-like product; and (c) recovering the liquid product from the unliquefied portion of the pretreated coal or similar carbonaceous material.

2. The process of claim 1 wherein the coal or similar solid carbonaceous material is ground such that all particles are less than ¼ inch in diameter.

3. The process of claim 2 wherein the coal or similar carbonaceous material is combined with a solvent and heated for a period of time within the range from about 15 to about 120 minutes during the hydrothermal pretreatment.

4. The process of claim 1 wherein the nominal contacting time during the hydrothermal treatment is within the range from about 15 to about 120 minutes.

5. The method of claim 1 wherein the liquefaction is accomplished in the presence of a hydrogen donor solvent.

6. The method of claim 5 wherein the liquefaction is accomplished in the presence of added molecular hydrogen.

7. The method of claim 6 wherein the liquefaction is accomplished at a temperature of about 700° to about 950° F. and at a pressure within the range from about 300 to about 3000 psig.

* * * * *